US011846262B2

(12) United States Patent
Sim et al.

(10) Patent No.: US 11,846,262 B2
(45) Date of Patent: Dec. 19, 2023

(54) IGNITION COIL CONTROL SYSTEM AND METHOD

(71) Applicants: HYUNDAI MOTOR COMPANY, Seoul (KR); KIA CORPORATION, Seoul (KR)

(72) Inventors: Kiseon Sim, Suwon-si (KR); Dongwon Jung, Gwacheon-si (KR); Won Gyu Kim, Seoul (KR); Jin Oh Song, Hwaseong-si (KR); Soo Hyung Woo, Seoul (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 9 days.

(21) Appl. No.: 17/359,962

(22) Filed: Jun. 28, 2021

(65) Prior Publication Data

US 2022/0275782 A1 Sep. 1, 2022

(30) Foreign Application Priority Data

Feb. 26, 2021 (KR) ..... 10-2021-0026111

(51) Int. Cl.

| | |
|---|---|
| ***F02P 3/045*** | (2006.01) |
| ***F02P 9/00*** | (2006.01) |
| ***F02P 3/05*** | (2006.01) |
| ***F02P 13/00*** | (2006.01) |

(52) U.S. Cl.

CPC ..... *F02P 3/045* (2013.01); *F02P 3/05* (2013.01); *F02P 9/007* (2013.01); *F02P 13/00* (2013.01)

(58) Field of Classification Search

CPC .... F02P 3/045; F02P 3/05; F02P 9/007; F02P 3/044; F02P 15/02; H02J 7/007

USPC ..... 123/634

See application file for complete search history.

(56) References Cited

U.S. PATENT DOCUMENTS 2,959,683 A * 11/1960 Trischka ..... H05H 3/00 315/156
4,095,564 A * 6/1978 Hochstein ..... F02P 15/005 123/211
4,625,691 A * 12/1986 Komurasaki ..... F02P 5/1525 123/406.33
4,938,200 A * 7/1990 Iwasaki ..... F02P 15/10 123/643
5,404,860 A * 4/1995 Morino ..... H01F 38/12 123/634
6,213,108 B1 * 4/2001 Boyer ..... F02P 3/02 123/595

(Continued)

FOREIGN PATENT DOCUMENTS

KR 101725156 B1 * 4/2017

*Primary Examiner* — Logan M Kraft
*Assistant Examiner* — Joshua Campbell
(74) *Attorney, Agent, or Firm* — LEMPIA SUMMERFIELD KATZ LLC

(57) ABSTRACT

An ignition coil control system includes: a first ignition coil; a second ignition coil; a spark plug generating spark discharge by a discharge current generated in the first ignition coil and the second ignition coil; and an ignition controller that controls spark discharge of the electrode by adjusting an amount and duration of the discharge current of the first ignition coil and the second ignition coil based on a step pulse signal including different voltages transmitted from an engine control unit (ECU).

15 Claims, 5 Drawing Sheets

(56) References Cited

U.S. PATENT DOCUMENTS

| | | | | |
|---|---|---|---|---|
| 8,078,384 | B2 * | 12/2011 | Glugla | F02P 15/08 701/110 |
| 9,429,134 | B2 | 8/2016 | Desai et al. | |
| 10,006,432 | B2 | 6/2018 | Desai et al. | |
| 2013/0241429 | A1 * | 9/2013 | Ruan | F02P 3/0456 315/213 |
| 2014/0102412 | A1 * | 4/2014 | Czekala | F02P 3/045 123/406.12 |
| 2018/0258901 | A1 * | 9/2018 | Terada | F02P 15/08 |

* cited by examiner

IGNITION COIL CONTROL SYSTEM AND METHOD

CROSS-REFERENCE TO RELATED APPLICATION

This application claims priority to and the benefit of Korean Patent Application No. 10-2021-0026111, filed on Feb. 26, 2021, the entire contents of which are incorporated herein by reference.

FIELD

The present disclosure relates to an ignition coil control system and method, and more particularly, to an ignition coil control system and method that may supply a current to an electrode of a spark plug.

BACKGROUND

The statements in this section merely provide background information related to the present disclosure and may not constitute prior art.

In gasoline vehicles, a mixture of air and fuel is ignited by a spark generated by a spark plug to be combusted. That is, the air-fuel mixture injected into a combustion chamber during a compression stroke is ignited by a discharge phenomenon of the spark plug, and thus energy required for vehicle's driving is generated while undergoing a high temperature and high pressure expansion process.

The spark plug provided in the gasoline vehicle serves to ignite a compressed air-fuel mixture by spark discharge caused by a high voltage current generated by an ignition coil.

In a spark plug mounted on a conventional gasoline vehicle, spark discharge between a pair of electrodes (a center electrode and a ground electrode) is generated by the high voltage current induced from the ignition coil. We have discovered that the spark plug has difficulties in controlling an ignition timing and/or discharge period of the spark plug according to an operational condition of an engine.

The above information disclosed in this Background section is only for enhancement of understanding of the background of the present disclosure, and therefore it may contain information that does not form the prior art that is already known to a person of ordinary skill in the art.

SUMMARY

The present disclosure provides an ignition coil control system and method that may variously control an ignition timing and discharge period of spark discharge generated between a pair of electrodes.

In one form of the present disclosure, an ignition coil control system includes: a first ignition coil; a second ignition coil; a spark plug generating spark discharge by a discharge current generated in the first ignition coil and the second ignition coil; and an ignition controller that controls spark discharge of the electrode by adjusting an amount and duration of the discharge current of the first ignition coil and the second ignition coil based on a step pulse signal including different voltages transmitted from an engine control unit (ECU).

The ignition controller may charge the first ignition coil and then discharge it, from a time point at which the step pulse signal is on to a time point at which a size of the step pulse signal is changed; and may charge the second ignition coil for a first dwell time and then discharge it, when a first delay time elapses from the time point at which the step pulse signal is on.

The first dwell time may be determined from a time point at which the step pulse signal is on to a time point at which the size of the step pulse signal is changed.

The ignition controller may charge the first ignition coil for a second dwell time and then discharge it, when a second delay time elapses from a time point at which a size of the step pulse signal is changed; and may charge the second ignition coil for the second dwell time and then discharge it, after discharging the first ignition coil.

Until the step pulse signal is off, charging and discharging of the first ignition coil and the second ignition coil may be repeated.

After the first ignition coil is initially discharged, a discharging period of the first ignition coil and a discharging period of the second ignition coil may overlap.

Another form of the present disclosure provides an ignition coil control system, including: a first ignition coil including a primary coil and a secondary coil; a first switch that selectively electrically connects the primary coil of the first ignition coil; a second ignition coil including a primary coil and a secondary coil; a second switch that selectively electrically connects the primary coil of the second ignition coil; a spark plug generating spark discharge by a discharge current generated in the first ignition coil and the second ignition coil; and an ignition controller that controls spark discharge of the spark plug by adjusting an amount and duration of the discharge current of the first ignition coil and the second ignition coil by turning the first switch and the second switch on or off based on a step pulse signal including different voltages transmitted from an engine control unit (ECU).

The ignition controller may charge the first ignition coil with electric energy by turning on the first switch when the step pulse signal is on, and discharge the first ignition coil by turning off the first switch when a size of the step pulse signal is changed; may charge the second ignition coil with electric energy for a first dwell time by turning on the second switch and then discharge it, when a first delay time elapses from a time point at which the step pulse signal is on; may charge the first ignition coil by turning on the first switch for a second dwell time and then discharge the first ignition coil by turning off the second switch, when a second delay time elapses from a time point when a size of the step pulse signal is changed; and may charges the second ignition coil by turning on the second switch for the second dwell time and then discharge the second ignition coil by turning off the second switch, after the first ignition coil is discharged.

The first dwell time may be determined from a time point at which the step pulse signal is on to a time point at which the size of the step pulse signal is changed.

The first dwell time may be determined as a time for which the first ignition coil and the second ignition coil are fully charged.

The ignition controller, until the step pulse signal is off, may repeat charging and discharging of the first ignition coil and the second ignition coil.

After the first ignition coil is initially discharged, a discharging period of the first ignition coil and a discharging period of the second ignition coil may overlap.

Another form of the present disclosure provides an ignition coil control method that includes a spark plug that generates spark discharge between a center electrode and a ground electrode through a current generated in a first ignition coil and a second ignition coil, including: receiving a step pulse signal including different voltages; charging the first ignition coil when the step pulse signal is on; charging the second ignition coil when a first delay time elapses from a time point at which the step pulse signal is on; discharging the first ignition coil when a size of the step pulse signal is changed; discharging the second ignition coil when a first dwell time elapses from a time point at which the second ignition coil is charged; when a second delay time elapses from a time point at which the step pulse signal is changed, charging the first ignition coil for a second dwell time and then discharging it; and after the first ignition coil is discharged, charging the second ignition coil for the second dwell time and then discharging it.

The first dwell time may be determined from a time point at which the step pulse signal is on to a time point at which the size of the step pulse signal is changed.

Until the step pulse signal is off, charging and discharging of the first ignition coil and the second ignition coil may be repeated.

After the first ignition coil is initially discharged, a discharging period of the first ignition coil and a discharging period of the second ignition coil may overlap.

According to the ignition coil control system and method according to the forms of the present disclosure as described above, it is possible to accurately control, by controlling charging and discharging of two ignition coils by using a step pulse signal transmitted from an engine control unit, an ignition timing in a combustion chamber through spark discharge generated between a center electrode and a ground electrode.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
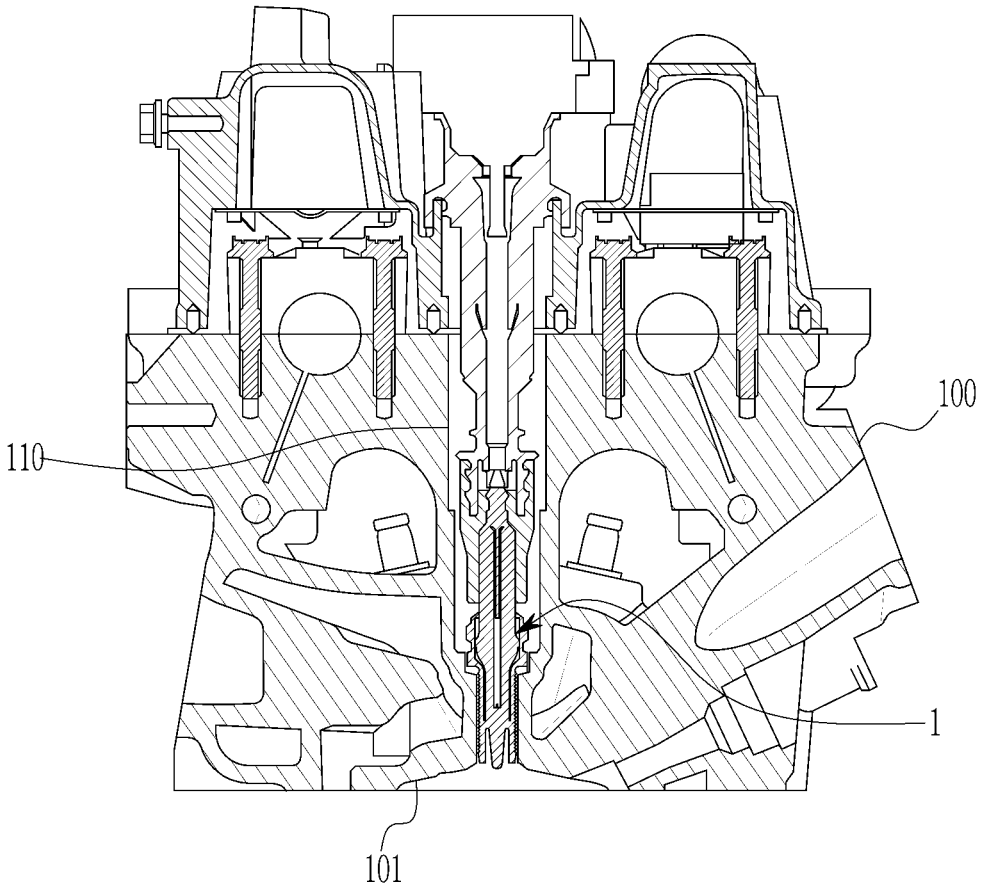
FIG. 1 illustrates a cross-sectional view of an engine in which a spark plug is mounted according to one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The present disclosure will be described more fully hereinafter with reference to the accompanying drawings, in which forms of the present disclosure are shown. As those skilled in the art would realize, the described forms may be modified in various different ways, all without departing from the spirit or scope of the present disclosure.

In order to clearly describe the present disclosure, parts that are irrelevant to the description are omitted, and identical or similar constituent elements throughout the specification are denoted by the same reference numerals.

In addition, since the size and thickness of each configuration shown in the drawings are arbitrarily shown for convenience of description, the present disclosure is not necessarily limited to configurations illustrated in the drawings, and in order to clearly illustrate several parts and areas, enlarged thicknesses are shown.

Hereinafter, a control system of an ignition coil according to some forms of the present disclosure will be described in detail with reference to the accompanying drawings.

FIG. 1 illustrates a cross-sectional view of an engine in which a spark plug is mounted according to one form of the present disclosure.

As shown in FIG. 1, a spark plug 1 is mounted on a cylinder of an engine, and generates spark discharge.

The engine to which the spark plug 1 is applied includes a cylinder block and a cylinder head 100, and the cylinder block and the cylinder head 100 are combined to form a combustion chamber 101 therein. An air and fuel mixture inflowing into the combustion chamber 101 is ignited by spark discharge generated by the spark plug 1.

The cylinder head 100 includes a mount hole 110 which is formed along a vertical direction of the cylinder head 100, and the spark plug 1 is vertically inserted into the mount hole 110. A lower portion of the spark plug 1 that is mounted in the mount hole 110 protrudes into the combustion chamber 101. A center electrode 2 and a ground electrode 3 that are electrically connected to an ignition coil are formed at the lower portion of the spark plug 1, and the spark discharge is generated between the center electrode 2 and the ground electrode 3.

Figure 2:
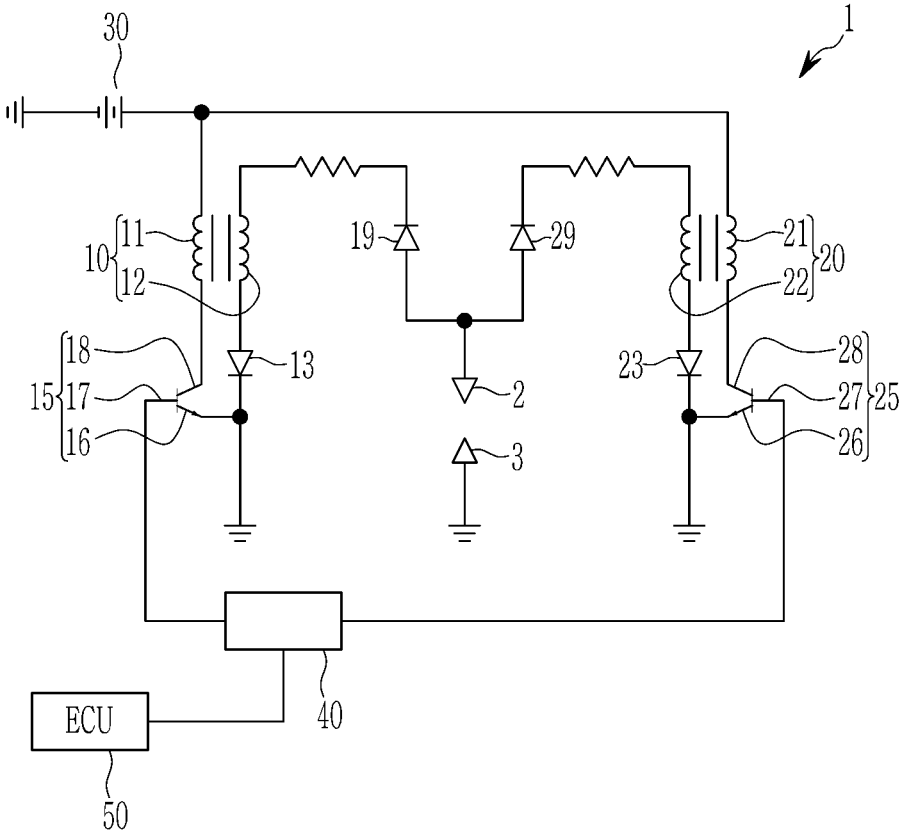
FIG. 2 illustrates a schematic view of an ignition coil control system according to another form of the present disclosure.

FIG. 2 illustrates a schematic view of an ignition coil control system according to one form of the present disclosure.

As shown in FIG. 2, the ignition coil control system may include an ignition controller 40 that adjusts amounts and durations of discharge currents of two ignition coils (a first ignition coil 10 and a second ignition coil 20) based on a step pulse signal including different voltages transmitted from an engine control unit 50 that controls an overall operation of an engine to control spark discharge generated at the electrodes.

The first ignition coil 10 includes a primary coil 11 and a secondary coil 12, one end of the primary coil 11 is electrically connected to a battery 30 of a vehicle, and the other end of the primary coil 11 is grounded through a first switch 15. According to an on/off operation of the first switch 15, the primary coil 11 of the first ignition coil 10 may be selectively electrically connected.

The first switch 15 may be realized with a transistor switch (for example, an insulated gate bipolar transistor (IGBT)) including an emitter terminal 16, a collector terminal 18, and a base terminal 17. That is, the other end of the primary coil 11 may be electrically connected to the collector terminal 18 of the first switch 15, the emitter terminal 16 thereof may be grounded, and the base terminal 17 thereof may be electrically connected to the ignition controller 40.

One end of the secondary coil 12 is electrically connected to the center electrode 2, and the other end thereof is electrically connected to the emitter terminal 16 of the first switch 15. A diode 13 is installed between the secondary coil 12 and the emitter terminal 16 to block a current from flowing from the secondary coil 12 to the emitter terminal 16.

In addition, a diode 19 is installed between the secondary coil 12 and the center electrode 2, so that a current flows only from the secondary coil 12 to the center electrode 2.

When a control signal is applied to the base terminal 17 of the first switch 15 by the ignition controller 40, the primary coil 11 of the first ignition coil 10 is electrically connected, and electrical energy is charged to the primary coil 11. When no control signal is applied to the base terminal 17 of the first switch 15 by the ignition controller 40, a high voltage current (or discharge current) is generated in the secondary coil 12 due to electromagnetic induction of the primary coil 11 and the secondary coil 12. The discharge current generated in the secondary coil 12 flows to the center electrode 2, and while spark discharge being generated between the center electrode 2 and the ground electrode 3 by the discharge current generated in the secondary coil 12, an air-fuel mixture inside the combustion chamber 101 is ignited.

That is, the ignition controller 40 charges or discharges the first ignition coil 10 by turning on/off the first switch 15. When the ignition controller 40 applies a control signal to the base terminal 17 of the first switch 15 (or when the switch is turned on), the primary coil 11 is charged (or the first ignition coil is charged).

In addition, when the ignition controller 40 does not apply a control signal to the base terminal 17 of the first switch 15 (or when the first switch is turned off), a high voltage current is generated in the secondary coil 12 due to electromagnetic induction with the primary coil 11, and spark discharge is generated between the center electrode 2 and the ground electrode 3 (or the first ignition coil is discharged) by the high voltage current generated in the secondary coil 12.

Like the first ignition coil 10, the second ignition coil 20 includes a primary coil 21 and a secondary coil 22, one end of the primary coil 21 is electrically connected to the battery 30 of the vehicle, and the other end of the primary coil 21 is grounded through a second switch 25. According to an on/off operation of the second switch 25, the primary coil 21 of the second ignition coil 20 may be selectively electrically connected.

The second switch 25 may be realized with a transistor switch (for example, an insulated gate bipolar transistor (IGBT)) including an emitter terminal 26, a collector terminal 28, and a base terminal 27. That is, the other end of the primary coil 21 may be electrically connected to the collector terminal 28 of the second switch 25, the emitter terminal 26 thereof may be grounded, and the base terminal 27 thereof may be electrically connected to the ignition controller 40.

One end of the secondary coil 22 is electrically connected to the center electrode 2, and the other end thereof is electrically connected to the emitter terminal 26 of the second switch 25. A diode 23 is installed between the secondary coil 22 and the emitter terminal 26 to block a current from flowing from the secondary coil 22 to the emitter terminal 26.

In addition, the diode 23 is installed between the secondary coil 22 and the center electrode 2, so that a current flows only from the secondary coil 22 to the center electrode 2.

When a control signal is applied to the base terminal 27 of the second switch 25 by the ignition controller 40, the primary coil 21 of the second ignition coil 20 is electrically connected, and electrical energy is charged to the primary coil 21. When no control signal is applied to the base terminal 27 of the second switch 25 by the ignition controller 40, a high voltage current (or discharge current) is generated in the secondary coil 22 due to electromagnetic induction of the primary coil 21 and the secondary coil 22. The discharge current generated in the secondary coil 22 flows to the center electrode 2, and while spark discharge being generated between the center electrode 2 and the ground electrode 3 by the discharge current generated in the secondary coil 22, an air-fuel mixture inside the combustion chamber 101 is ignited.

That is, the ignition controller 40 charges or discharges the second ignition coil 20 by turning the second switch 25 on/off. When the ignition controller 40 applies a control signal to the base terminal 27 of the second switch 25 (or when the switch is turned on), the primary coil 21 is charged (or the second ignition coil is charged).

In addition, when the ignition controller 40 does not apply a control signal to the base terminal 27 of the second switch 25 (or when the second switch is turned off), a high voltage current is generated in the secondary coil 22 due to electromagnetic induction with the primary coil 21, and spark discharge is generated between the center electrode 2 and the ground electrode 3 (or the second ignition coil is discharged) by the high voltage current generated in the secondary coil 22.

In the exemplary forms of the present disclosure, charging the primary coil of the first ignition coil 10 by turning on the first switch 15 is described as charging the first ignition coil 10, and a high voltage current is induced to the secondary coil of the first ignition coil 10 by turning off the first switch 15 and thus spark discharge occurs between the center electrode 2 and the ground electrode 3 is described as the first ignition coil 10 being discharged.

Likewise, charging the primary coil of the second ignition coil 20 by turning on the second switch 25 is described as charging the second ignition coil 20, and a high voltage current is induced to the secondary coil of the second ignition coil 20 by turning off the second switch 25 and thus spark discharge occurs between the center electrode 2 and the ground electrode 3 is described as the second ignition coil 20 being discharged.

In one form, the ignition coil control system controls the charging and discharging of the two ignition coils based on the step pulse signal transmitted from the engine control unit 50, so that it is possible to accurately control the ignition timing of the spark discharge generated between the center electrode 2 and the ground electrode 3.

To this end, the ignition controller 40 may be provided as at least one processor executed by a predetermined program, and the predetermined program is configured to perform respective steps of a control method of the spark plug 1 according to one form of the present disclosure.

Hereinafter, the operation of the ignition coil control system according to the form of the present disclosure as described above will be described in detail with reference to the accompanying drawings.

Figure 3:
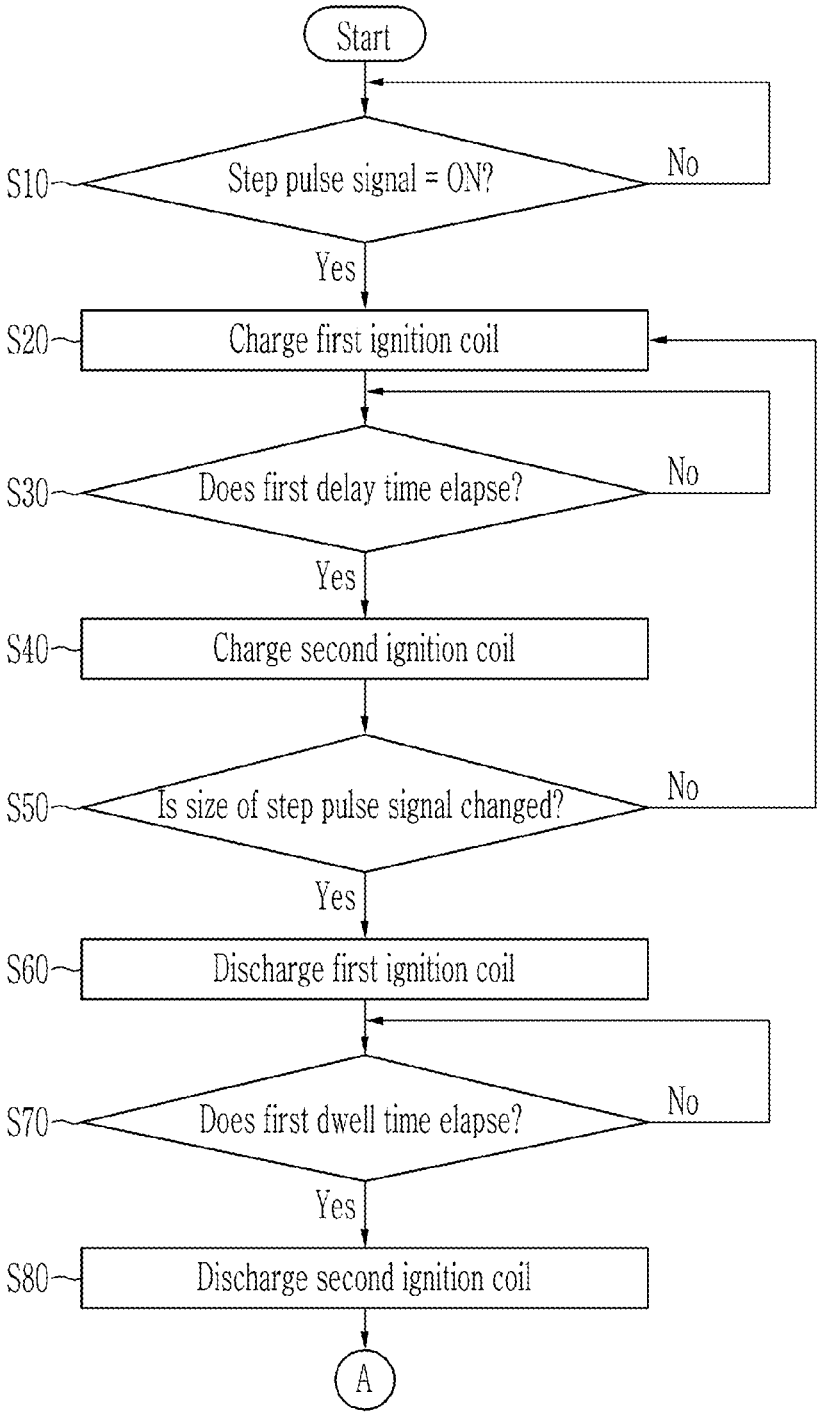
FIG. 3 and FIG. 4 illustrate flowcharts of an ignition coil control method according to another form of the present disclosure.
Figure 4:
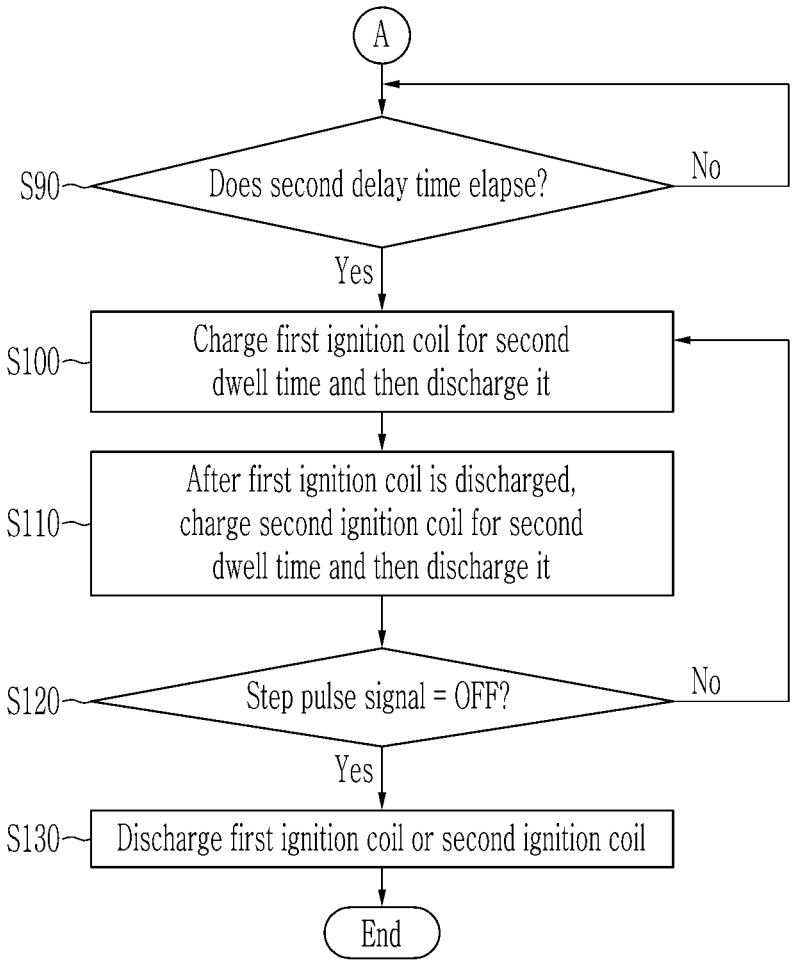

FIG. 3 and FIG. 4 illustrate flowcharts of an ignition coil control method according to another form of the present disclosure. In addition, FIG. 5 illustrates an operation of two ignition coils according to one form of the present disclosure.

Figure 5:
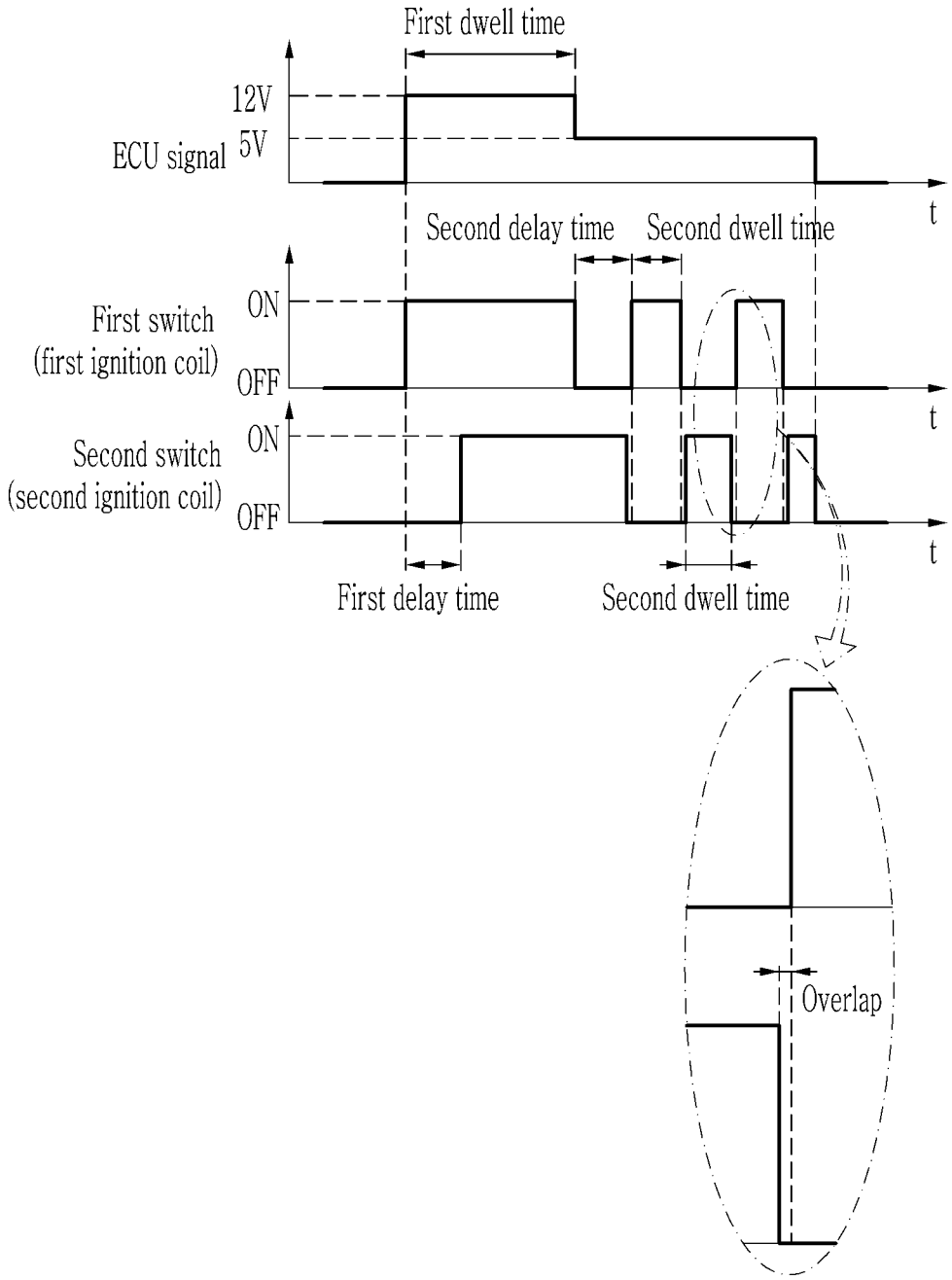
FIG. 5 illustrates an operation of two ignition coils according to one form of the present disclosure.

As shown in FIG. 3 to FIG. 5, the engine control unit (ECU) 50 transmits a pulse signal (or ECU signal) to the ignition controller 40 to ignite the air-fuel mixture inflowing into the combustion chamber 101 during an explosion stroke of the engine. In this case, the pulse signal transmitted from the engine control unit 50 to the ignition controller 40 may be a step pulse signal including different voltages. That is, the voltage of the step pulse signal may be initially set to 12 V, and then may be changed to 5 V.

Here, a time (first dwell time) from a time point at which the step pulse signal is on to a time point at which a size of the step pulse signal is changed may be determined as a time during which the first ignition coil 10 and the second ignition coil 20 are fully charged. In this case, the time during which the first ignition coil 10 and the second ignition coil 20 are fully charged may be changed according to the output voltage of the battery 30. For example, when the output voltage of the battery 30 is high, the first dwell time may be shortened, and when the output voltage of the battery 30 is low, the first dwell time may be lengthened.

When the step pulse signal is transmitted from the engine control unit 50, the ignition controller 40 charges and then discharges the first ignition coil 10 in synchronization with the step pulse signal. That is, when the step pulse signal is on (S10), the ignition controller 40 turns on the first switch 15 to charge the first ignition coil 10 (S20).

When a first delay time elapses from the time point at which the step pulse signal is on (S30), the ignition controller 40 turns on the second switch 25 to charge the second ignition coil 20 (S40).

The ignition controller 40 discharges the first ignition coil 10 by turning off the first switch 15 in synchronization with the time point at which the size of the step pulse signal is changed. That is, when the size of the step pulse signal is changed (S50), the first switch 15 is turned off to discharge the first ignition coil 10 (S60).

When the first dwell time elapses from the charging time point of the second ignition coil 20 (S70), the ignition controller 40 discharges the second ignition coil 20 by turning off the second switch 25 (S80). Here, the first dwell time may be a time from a time point at which the step pulse signal is on to a time point at which the size of the step pulse signal is changed. Alternatively, the first dwell time may be a time during which the first ignition coil 10 and the second ignition coil 20 are fully charged.

When a second delay time elapses from the time point at which the size of the step pulse signal is changed (S90), the ignition controller 40 charges the first ignition coil 10 by turning on the first switch 15 during the second dwell time, and discharges the first ignition coil 10 by turning off the first switch 15 when the second dwell time elapses (S100). Here, the second dwell time may be set to be shorter than the first dwell time.

After the first ignition coil 10 is discharged, the ignition controller 40 charges the second ignition coil 20 by turning on the second switch 25 during the second dwell time, and discharges the second ignition coil 20 by turning off the second switch 25 when the second dwell time elapses (S100).

When the step pulse signal is not turned off (S120), steps S100 and S110 are repeated. That is, the ignition controller 40 repeats charging and discharging of the first ignition coil 10 and the second ignition coil 20 until the step pulse signal is off.

In this case, after the first ignition coil 10 is initially discharged, the ignition controller 40 adjusts the charging timing and discharging timing of the first ignition coil 10, and the charging timing and discharging timing of the second ignition coil 20, so that a charging period of the first ignition coil 10 and a charging period of the second ignition coil 20 do not overlap. In other words, after the first ignition coil 10 is initially discharged, the discharging period of the first ignition coil 10 and the discharging period of the second ignition coil 20 may overlap.

As described above, when the discharging period of the first ignition coil 10 and the discharging period of the second ignition coil 20 overlap, the spark discharge is continuously generated between the center electrode 2 and the ground electrode 3, and ignition energy may be efficiently transmitted to the air-fuel mixture in the combustion chamber 101. Therefore, the discharge efficiency of the spark plug 1 may be improved.

When the step pulse signal is off (S120), the ignition controller 40 discharges the first ignition coil 10 or the second ignition coil 20 (S130). For example, when the step pulse signal is off while the first ignition coil 10 is being charged, the ignition controller 40 discharges the first ignition coil 10 when the step pulse signal is off. In addition, when the step pulse signal is off while the second ignition coil 20 is being charged, the ignition controller 40 discharges the second ignition coil 20 when the step pulse signal is off.

According to the spark plug 1 according to the form of the present disclosure as described above, by controlling the charging and discharging of the two ignition coils by using the step pulse signal transmitted from the engine control unit 50, the ignition timing in the combustion chamber 101 through the spark discharge generated between the center electrode 2 and the ground electrode 3 may be accurately controlled.

In addition, by using the step pulse signal transmitted from the engine control unit 50, the multi-stage ignition of the spark plug may be easily controlled. That is, by fully charging and then discharging the first ignition coil 10 and the second ignition coil 20 by using the time point at which the step pulse signal is on and the time point at which the size of the step pulse signal is changed, sufficient ignition energy may be supplied into the combustion chamber 101. In addition, multi-stage ignition may be easily implemented by repeating the charging and discharging of the first ignition coil 10 and the second ignition coil 20 based on the time point at which the size of the step pulse signal is changed.

Through this, the initial combustion speed is prevented from increasing, and knocking is prevented, so that the engine output and fuel economy may be improved. In addition, even when the ignition property of the air-fuel mixture is degraded, such as when EGR gas is supplied to the combustion chamber 101 of the engine or a lean combustion occurs, sufficient ignition energy may be supplied into the combustion chamber 101.

While this present disclosure has been described in connection with what is presently considered to be practical exemplary forms, it is to be understood that the present disclosure is not limited to the disclosed forms, but, on the contrary, is intended to cover various modifications and equivalent arrangements included within the spirit and scope of the present disclosure.

DESCRIPTION OF SYMBOLS

1: spark plug
2: center electrode
3: ground electrode
10: first ignition coil
11: primary coil
12: secondary coil
13: diode
15: first switch
16: emitter terminal

17: base terminal
18: collector terminal
19: diode
20: second ignition coil
21: primary coil
22: secondary coil
23: diode
25: second switch
26: emitter terminal
27: base terminal
28: collector terminal
29: diode
30: battery
40: ignition controller
50: engine control unit
100: cylinder head
101: combustion chamber
110: mount hole

What is claimed is:

1. An ignition coil control system, comprising:
a first ignition coil;
a second ignition coil;
a spark plug configured to generate spark discharge by a discharge current generated in the first ignition coil and the second ignition coil; and
an ignition controller configured to:
adjust an amount and a duration of the discharge current of the first ignition coil and the second ignition coil based on a step pulse signal including different voltages transmitted from an engine control unit (ECU), and
control the spark discharge of the spark plug based on the adjusted amount and duration of the discharge current,
wherein the ignition controller is further configured to:
charge the first ignition coil with electric energy from a time point at which the step pulse signal is on to a time point at which a size of the step pulse signal is changed; and
charge the second ignition coil with electric energy for a first dwell time when a first delay time elapses from the time point at which the step pulse signal is on.

2. The ignition coil control system of claim 1, wherein the first dwell time is determined from the time point at which the step pulse signal is on to the time point at which the size of the step pulse signal is changed.

3. The ignition coil control system of claim 1, wherein the ignition controller is further configured to:
charge the first ignition coil for a second dwell time and then discharge when a second delay time elapses from the time point at which the size of the step pulse signal is changed; and
charge the second ignition coil for the second dwell time and then discharge after discharging the first ignition coil.

4. The ignition coil control system of claim 3, wherein charging and discharging the first ignition coil and the second ignition coil are repeated until the step pulse signal is off.

5. The ignition coil control system of claim 3, wherein after the first ignition coil is initially discharged, a discharging period of the first ignition coil and a discharging period of the second ignition coil overlap.

6. An ignition coil control system, comprising:
a first ignition coil including a primary coil and a secondary coil;
a first switch configured to selectively electrically connect the primary coil of the first ignition coil;
a second ignition coil including a primary coil and a secondary coil;
a second switch configured to selectively electrically connect the primary coil of the second ignition coil;
a spark plug configured to generate spark discharge by a discharge current generated in the first ignition coil and the second ignition coil; and
an ignition controller configured to control the spark discharge of the spark plug by adjusting an amount and a duration of the discharge current of the first ignition coil and the second ignition coil by turning the first switch and the second switch on or off based on a step pulse signal including different voltages transmitted from an engine control unit (ECU),
wherein the ignition controller is further configured to:
charge the first ignition coil by turning on the first switch when the step pulse signal is on; and
charge the second ignition coil for a first dwell time by turning on the second switch when a first delay time elapses from a time point at which the step pulse signal is on.

7. The ignition coil control system of claim 6, wherein the ignition controller is configured to:
discharge the first ignition coil by turning off the first switch when a size of the step pulse signal is changed;
charge the first ignition coil by turning on the first switch for a second dwell time and then discharge the first ignition coil by turning off the second switch when a second delay time elapses from a time point when the size of the step pulse signal is changed; and
charge the second ignition coil by turning on the second switch for the second dwell time and then discharge the second ignition coil by turning off the second switch after the first ignition coil is discharged.

8. The ignition coil control system of claim 7, wherein the first dwell time is determined from the time point at which the step pulse signal is on to the time point at which the size of the step pulse signal is changed.

9. The ignition coil control system of claim 7, wherein the first dwell time is determined as a time period for which the first ignition coil and the second ignition coil are fully charged.

10. The ignition coil control system of claim 7, wherein the ignition controller is configured to repeat charging and discharging the first ignition coil and the second ignition coil until the step pulse signal is off.

11. The ignition coil control system of claim 7, wherein after the first ignition coil is initially discharged, a discharging period of the first ignition coil and a discharging period of the second ignition coil overlap.

12. An ignition coil control method for an ignition coil control system, where the ignition coil control system includes a spark plug configured to generate spark discharge between a center electrode and a ground electrode through a current generated in a first ignition coil and a second ignition coil, the ignition coil control method comprising:
receiving, by a controller, a step pulse signal including different voltages;
charging, by the controller, the first ignition coil when the step pulse signal is on;
charging, by the controller, the second ignition coil when a first delay time elapses from a time point at which the step pulse signal is on;
discharging, by the controller, the first ignition coil when a size of the step pulse signal is changed;

discharging, by the controller, the second ignition coil when a first dwell time elapses from a time point at which the second ignition coil is charged;

when a second delay time elapses from the time point at which the step pulse signal is changed, charging, by the controller, the first ignition coil for a second dwell time and then discharging; and after the first ignition coil is discharged, charging, by the controller, the second ignition coil for the second dwell time and then discharging.

13. The ignition coil control method of claim 12, wherein the first dwell time is determined from the time point at which the step pulse signal is on to a time point at which the size of the step pulse signal is changed.

14. The ignition coil control method of claim 12, further comprising:

repeatedly charging and discharging the first ignition coil and the second ignition coil until the step pulse signal is off.

15. The ignition coil control method of claim 12, wherein after the first ignition coil is initially discharged, a discharging period of the first ignition coil and a discharging period of the second ignition coil overlap.

* * * * *